US007399049B2

(12) United States Patent
Jahana et al.

(10) Patent No.: US 7,399,049 B2
(45) Date of Patent: Jul. 15, 2008

(54) INK JET PRINTING APPARATUS, INK JET PRINTING METHOD, METHOD OF SETTING PRINT CONTROL MODE, AND PROGRAM

(75) Inventors: Ryoki Jahana, Kawasaki (JP); Satoshi Wada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 98 days.

(21) Appl. No.: 11/443,156

(22) Filed: May 31, 2006

(65) Prior Publication Data

US 2006/0274099 A1 Dec. 7, 2006

(30) Foreign Application Priority Data

Jun. 3, 2005 (JP) ..... 2005-164452

(51) Int. Cl.
*B41J 29/393* (2006.01)

(52) U.S. Cl. ..... 347/19

(58) Field of Classification Search ..... 347/13, 347/42, 19, 12, 14, 40, 43, 15, 49
See application file for complete search history.

(56) References Cited

U.S. PATENT DOCUMENTS 5,847,723 A 12/1998 Akahira et al.
6,886,899 B2 * 5/2005 Kuwahara ..... 347/13
2005/0116983 A1 6/2005 Wada et al.
2005/0134617 A1 6/2005 Yamaguchi et al.
2005/0275684 A1 12/2005 Yamaguchi et al.
2006/0119632 A1 6/2006 Ochiai et al.
2006/0119660 A1 6/2006 Ochiai et al.
2006/0214957 A1 9/2006 Wada

FOREIGN PATENT DOCUMENTS

EP 0 914 950 5/1999
EP 1 176 019 1/2002
EP 1 375 146 1/2004
JP 5-57965 3/1993

* cited by examiner

*Primary Examiner*—Lamson D. Nguyen
(74) *Attorney, Agent, or Firm*—Fitzpatrick, Cella, Harper & Scinto

(57) ABSTRACT

When a malfunction nozzle occurs in a joint portion of print elements in a print head, the print head is controlled to minimize image impairments caused by the malfunction nozzle. This prevents an increase in cost of the print head and increases the printing speed while at the same time realizing a high quality of printed image. For the control of the overlapping nozzles in the adjoining print chips, a desired control mode is selectively set from among a plurality of control modes, the control modes having different nozzles removed from use.

10 Claims, 8 Drawing Sheets

INK JET PRINTING APPARATUS, INK JET PRINTING METHOD, METHOD OF SETTING PRINT CONTROL MODE, AND PROGRAM

BACKGROUND OF THE INVENTION

1. Field of the Invention

The present invention relates to an ink jet printing apparatus that forms an image by using a print head having a plurality of print elements each comprising a plurality of ink ejection nozzles arrayed in line. The present invention also relates to an ink jet printing method, a method of setting a print control mode, and a program.

2. Description of the Related Art

A printing apparatus of an ink jet system (ink jet printing apparatus) that ejects ink from nozzles arrayed in an ink jet print head to form an image on a print medium is finding a wide range of applications in such equipment as printers, facsimile machines and copying machines. A color printer capable of forming a color image using a plurality of color inks, in particular, is becoming increasingly popular as its print quality is enhanced.

In such ink jet printing apparatus, an increased printing speed as well as the enhanced print quality constitutes an important factor for their widespread use. An effort to increase the printing speed is being made, which includes increasing a drive frequency of ink ejection from the print head and using a greater number of nozzles arrayed in the print head. A technique currently available to dramatically enhance the printing speed, for example, involves elongating the print head and increasing a nozzle arrangement density to print in one scan an image that is otherwise printed in a plurality of scans.

Among the methods for elongating the print head, it is the most desirable in terms of production cost to arrange a plurality of print heads in line. More specifically, where each of the print heads is constructed of a chip having a plurality of nozzles, an elongate print head is formed by arranging in line the same number of chips as the print heads. In the following description a portion connecting the adjoining chips, each composed of a plurality of nozzles, is taken as a joint between the print heads.

At a portion of the printed image corresponding to the joint between the print heads, an image flaw that looks like a white line is likely to be produced. This is caused by a phenomenon in which an air flow produced between the print head and the print medium deflects ink droplets coming out of those nozzles at the ends of a nozzle column toward the inside of the nozzle column. As a result, the ink droplets fail to land where they are intended (this is also called an "end dot deflection"). Other possible causes for the stripe-like image defect include a difference in ink ejection volume among the print heads, a precision of arranging a plurality of print heads in line, and variations in time taken by ink droplets to land on the print medium.

To prevent such a stripe-like image flaw that occurs at a part of the printed image corresponding to the joint between the print heads, a method has been proposed, as in Japanese Patent Disclosure No. 5-57965, which overlaps the nozzles at the joint portion of the print heads.

In the ink jet print head, however, there is a possibility of ink droplets failing to be ejected normally (so-called "ejection failure"), which may be caused by dirt that enters into nozzles during manufacture, degradation of nozzles over the long period of use, and deterioration of ink ejection elements. If such faulty nozzles occur at the joint portion between the print heads, they in combination with the "end dot deflection", the cause of the stripe-like image flaw, may produce more serious image impairments.

Even if the nozzles are not completely in the ejection failure state, the stripe-like image impairments such as caused by the ejection failure would likely occur also when the ink droplet ejection direction greatly deviates from an intended direction (also called an "excessive ejection deflection") or when the ink droplet ejection volume differs greatly from the desired one (also referred to as an "ejection volume variation" or "drop diameter variation"). If nozzles in such an "excessive ejection deflection" state or "ejection volume variation" state should occur in the joint portion between the print heads, worse image impairments would result.

To realize both an increased printing speed and an enhanced print image, a method may be conceived that uses two print heads that eject inks of the same color and performs one print head scan to print at high speed with almost the same level of image quality that can be achieved with two scans (this method is referred to also as a "dual head configuration"). In this dual head configuration, if abnormal nozzles in the state of "ejection failure", "excessive ejection deflection" or "ejection volume variation" should occur in one print head, the nozzles in the other print head that ejects the same color ink can complement the printing operation in place of the abnormal nozzles. However, if those nozzles of the second print head that are supposed to perform the complementary printing have troubles such as "ejection failure", "excessive ejection deflection" or "ejection volume variation", the desired complementary printing cannot be done.

The "ejection failure", "excessive ejection deflection" and "ejection volume variation" of the abnormal nozzles have been able to be suppressed in the frequency of occurrence by improving the print head manufacturing environments and thus have not posed a serious problem. However, when two or more print heads are arrayed in line to increase the number of nozzles for faster printing speed, the "ejection failure", "excessive ejection deflection" or "ejection volume variation" of the abnormal nozzles cannot be ignored. Efforts to produce print heads that do not include abnormal nozzles or which do not easily cause "ejection failure" will entail an increase in manufacturing cost, making the print heads very expensive.

SUMMARY OF THE INVENTION

The present invention can provide an ink jet printing apparatus which, when abnormal nozzles occur at a joint portion between print heads, controls the print heads to prevent image impairments from being produced by the abnormal nozzles, thereby ensuring a high quality of the printed image while minimizing a cost increase of the print head and increasing a printing speed. The present invention can also provide an ink jet printing method, a method of setting a print control mode and a program.

In the first aspect of the present application, there is provided an ink jet printing apparatus for printing an image by using a print head having a plurality of print elements, each of the print elements providing a plurality of ink ejection nozzles arrayed in line, a predetermined number of the nozzles in two adjoining print elements being overlapped, the print head and a print medium being moved relative to each other in a direction crossing a direction in which the nozzles are arrayed, the ink jet printing apparatus comprising:

a setting means capable of selectively setting a desired control mode from among a plurality of control modes for the predetermined number of nozzles, the control modes having different nozzles removed from use.

In the second aspect of the present application, there is provided an ink jet printing method for printing an image by using a print head having a plurality of print elements, each of the print elements providing a plurality of ink ejection nozzles arrayed in line, a predetermined number of the nozzles in two adjoining print elements being overlapped, the print head and a print medium being moved relative to each other in a direction crossing a direction in which the nozzles are arrayed, the ink jet printing method comprising the step of:

selectively setting a desired control mode from among a plurality of control modes for the predetermined number of nozzles, the control modes having different nozzles removed from use.

In the third aspect of the present application, there is provided a print control mode setting method to set a control mode when printing an image by using a print head having a plurality of print elements, each of the print elements providing a plurality of ink ejection nozzles arrayed in line, a predetermined number of the nozzles in two adjoining print elements being overlapped, the print head and a print medium being moved relative to each other in a direction crossing a direction in which the nozzles are arrayed, the print control mode setting method comprising the step of:

selectively setting a desired control mode from among a plurality of control modes for the predetermined number of nozzles, the control modes having different nozzles removed from use.

In the fourth aspect of the present application, there is provided a program to set a control mode when printing an image by using a print head having a plurality of print elements, each of the print elements providing a plurality of ink ejection nozzles arrayed in line, a predetermined number of the nozzles in two adjoining print elements being overlapped, the print head and a print medium being moved relative to each other in a direction crossing a direction in which the nozzles are arrayed, the print control mode setting method comprising the step of:

having a computer selectively set a desired control mode from among a plurality of control modes for the predetermined number of nozzles, the control modes having different nozzles removed from use.

This invention offers a method for controlling nozzles of the overlapping print heads. With this control method the print heads can be controlled so as not to use abnormal nozzles by selectively setting a control mode from among a plurality of control modes that take different nozzles out of service. As a result, when abnormal nozzles occur at a joint portion between the print heads, the print heads can be controlled to prevent an image flaw from being produced by the abnormal nozzles, thereby enhancing the print quality of the image while preventing a cost increase of the print heads and increasing the printing speed.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of this invention will be described by referring to the accompanying drawings.

First Embodiment

First, an example of a fundamental construction of the ink jet printing apparatus will be explained.

Figure 7:
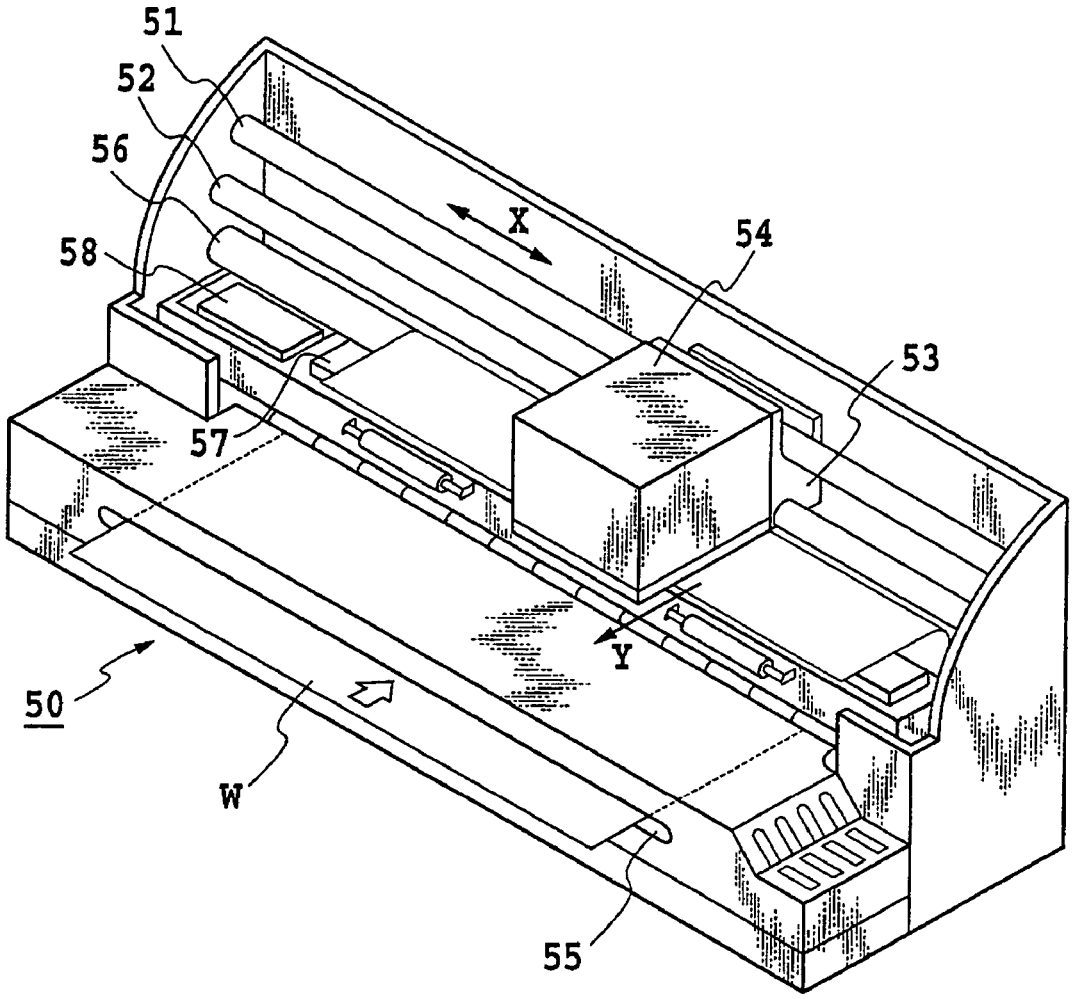
FIG. 7 is a schematic perspective view of an ink jet printing apparatus that can apply this invention.

FIG. 7 is a perspective view showing an outline construction of the printing apparatus that can apply the present invention. The printing apparatus 50 of this example is of a serial scan type and has a carriage 53 movably guided in a main scan direction indicated by arrow X along guide shafts 51, 52. The carriage 53 is reciprocally moved in the main scan direction by a carriage motor and a drive force transmission mechanism such as belt. Mounted on the carriage 53 are an ink jet print head 10 (not shown in FIG. 7) and an ink tank 54 to supply ink to the print head 10. The print head 10 and the ink tank 54 may combine to form an ink jet cartridge.

The ink jet print head 10 is formed with a plurality of openings that form ink ejection nozzles and uses electrothermal transducers (heaters) or piezoelectric elements as ink ejection energy generation elements. When a heater is used, it heats ink to form a bubble in ink and, by the force of the expanding bubble, expels an ink droplet from the nozzle opening.

Paper W as a print medium is inserted into an insertion opening 55 formed at the front side of the apparatus and is reversed in its transport direction and then fed by a feed roller 56 in a subscan direction indicated by arrow Y. The printing apparatus 50 forms an image of a predetermined print width by a printing operation that causes the print head 10 to eject ink onto the paper W on a platen 57 as the print head moves in the main scan direction. The printing apparatus 50 then feeds the paper W in the subscan direction over a distance corresponding to the print width. The printing apparatus 50 repetitively alternates the printing operation and the feeding operation to successively form images on the paper W.

At the left end of the stroke of the carriage 53 in FIG. 7 there is provided a recovery unit (recovery means) 58 that faces the nozzle opening formation surface of the print head 10 mounted on the carriage 53. The recovery unit 58 has a cap capable of capping the nozzle openings 15 of the print head 10 and a suction pump to introduce a negative pressure into the cap. In the recovery operation (also referred to as a suction-based recovery operation) the recovery unit 58 sucks out ink from the nozzle openings 15 by introducing the negative pressure into the cap covering the nozzle openings 15 to maintain the print head 10 in a good ink ejection state. The recovery operation can also be performed by ejecting ink not used for forming an image from the nozzle openings 15 into the cap to maintain the ink ejection performance of the print head in good condition (also referred to as an ejection-based recovery operation).

Figure 8:
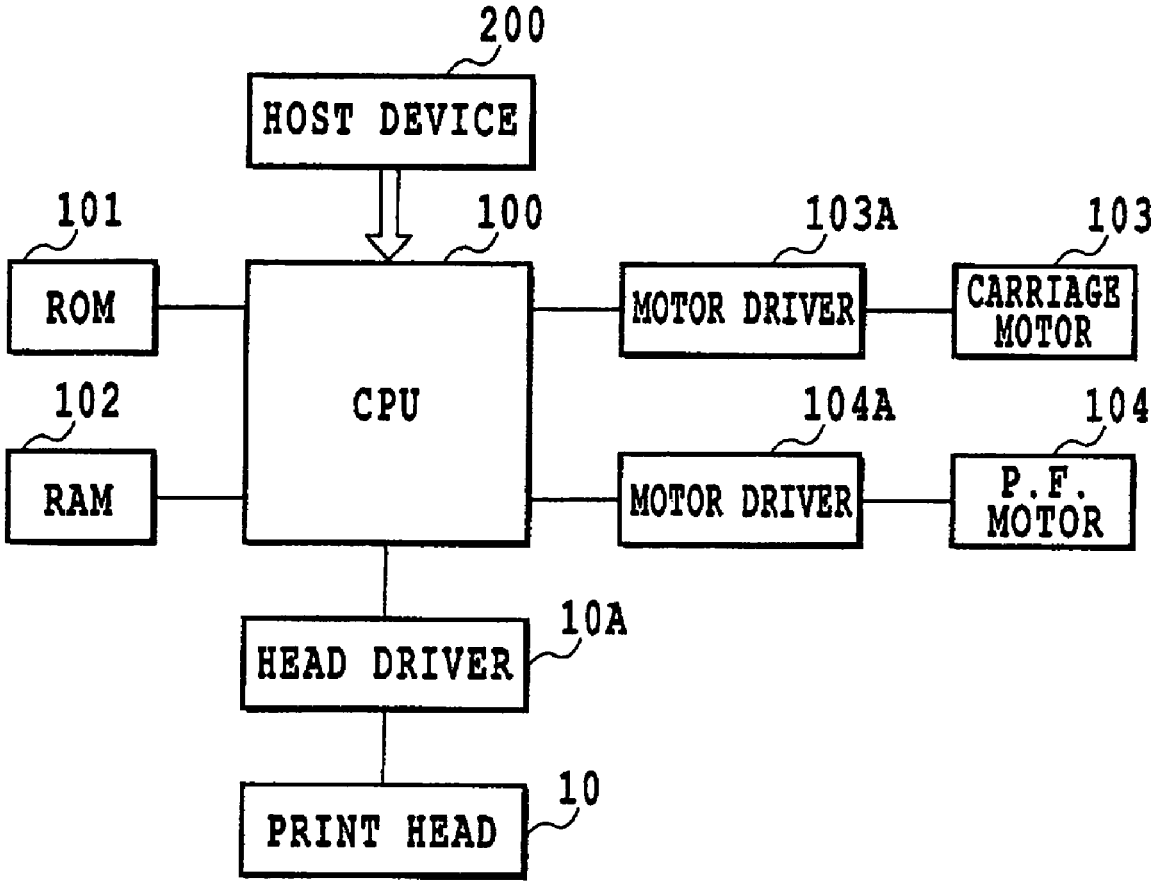
FIG. 8 is a block diagram showing a configuration of a control system for the ink jet printing apparatus of FIG. 7.

FIG. 8 is an outline configuration block diagram of the control system of the ink jet printing apparatus of FIG. 7.

In FIG. 8, a CPU 100 controls the operation of the printing apparatus and executes data processing. A ROM 101 stores programs representing procedures of such processing. A RAM 102 is used as a work area for executing the processing. The ink ejection from the print head 10 is performed by the CPU 100 supplying drive data (image data) to the ejection energy generation elements such as heaters and a drive control signal (heat pulse signal) to the head driver 10A. The CPU 100 controls through a motor driver 103A the carriage motor 103 for driving the carriage 53 in the main scan direction and also controls through a motor driver 104A a P.F motor 104 for transporting the paper W in the subscan direction.

Further, as described later, the CPU 100 also functions as a means for setting a print head control mode. The setting means selectively sets a control mode of the nozzles in the print head from among a plurality of control modes that remove different nozzles out of service. According to a program stored in the ROM 101 or a program loaded from an external device including a host device 200 into the RAM 102, the CPU 100 executes processing to function as the setting means.

Figure 1:
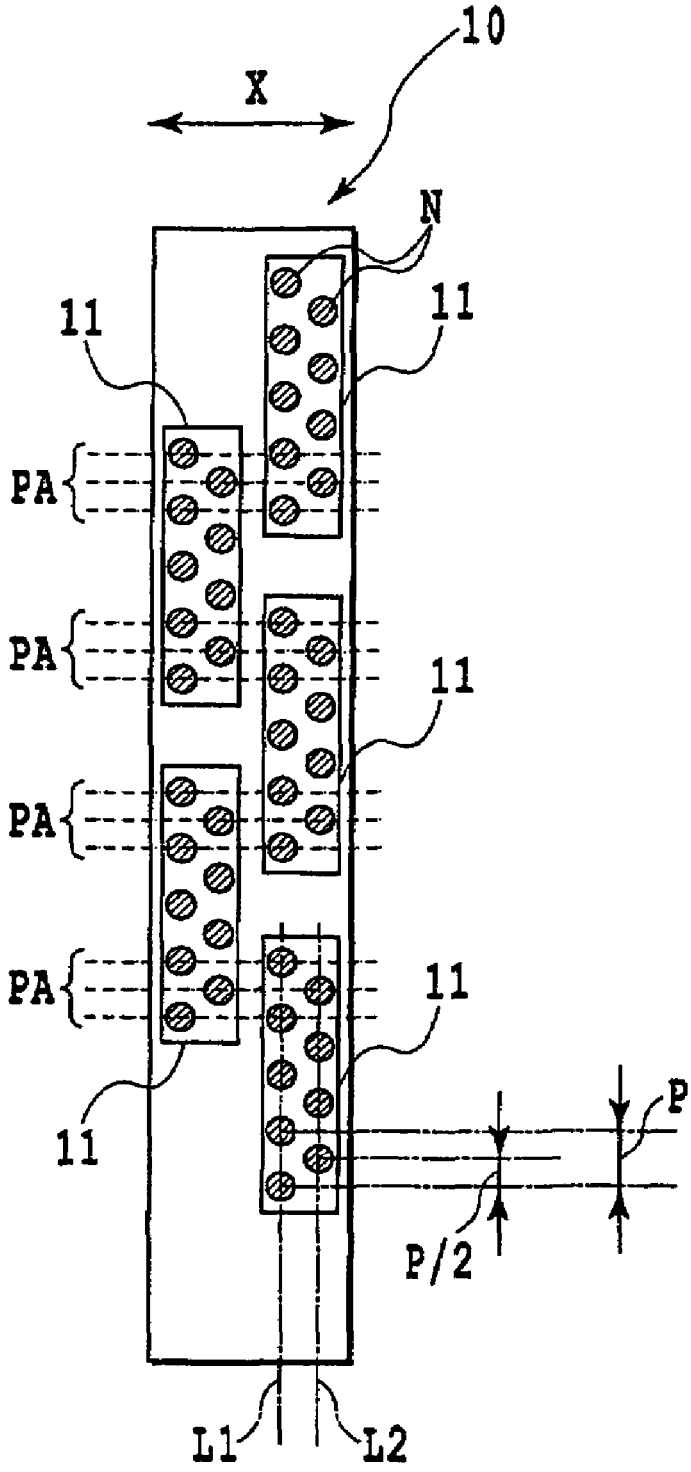
FIG. 1 illustrates an outline configuration of print heads used in a first embodiment of this invention.

FIG. 1 is an explanatory diagram showing an example construction of the ink jet print head 10 used in the first embodiment of this invention.

The print head 10 of this example has a plurality of in-line chips 11 (in this case five). In each of chips 11, a plurality of nozzles N providing ejection energy generation means are formed as a print element. The nozzles N in each chip 11 are arranged in two lines L1, L2 at a predetermined pitch P, with the two lines of nozzles staggered by half the pitch (P/2). At joint portions PA of the adjoining chips 11, a predetermined number of nozzles N in each of the adjoining chips 11 overlap in the main scan direction indicated by arrow X. In this example, for the sake of explanation, each chip 11 has nine nozzles and at the joint portion PA there are three overlapping nozzles in each chip. In the following description, the joint portion PA of the chips 11 is also referred to as a joint portion of the print head.

The phenomenon called "end dot deflection" is likely to occur with the nozzles N situated at the ends of the chip 11. That is, ink droplets ejected from the nozzles N at the ends of the chip 11 are influenced by an air flow produced between the print head 10 and the paper W and thus are likely to deflect inwardly of the chip 11 from the intended landing positions on the paper W. When such an end dot deflection occurs, a white stripe-like image flaw may be produced at a portion of the printed image corresponding to the joint portion PA. The nozzles N at the joint portion PA may also produce such troubles as "ejection failure", "excessive deflection of ejected drops" and "ejection volume variation". If such malfunction nozzles exist in the joint portion PA, the possibility becomes even higher that image impairments may occur at a portion of the printed image corresponding to the joint portion PA.

Figure 2:
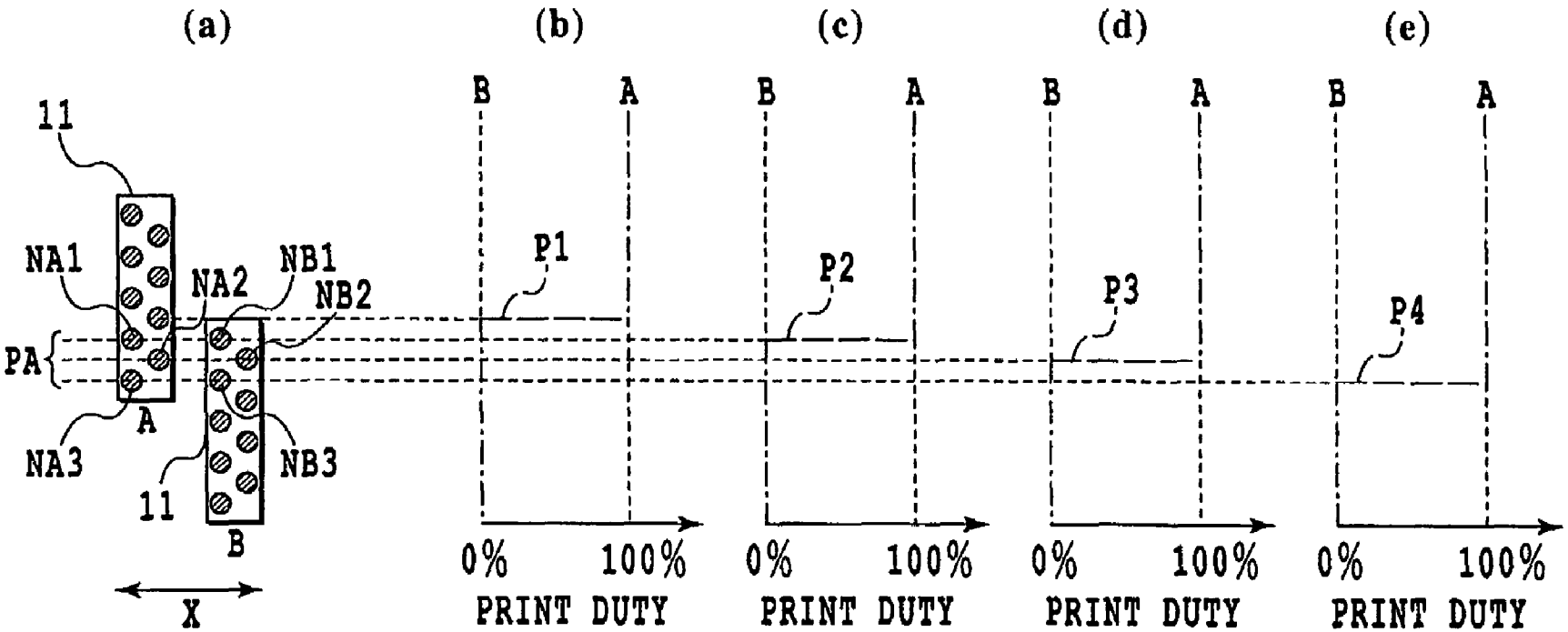
FIG. 2 is an explanatory diagram showing a control mode for the print heads of FIG. 1.

In this example, if there is abnormal nozzle among the overlapping nozzles in the joint portion PA, the nozzles to be used are chosen to avoid the malfunction nozzle, as shown in FIG. 2.

As shown at (a) of FIG. 2, one of the adjoining chips 11, 11 is called a chip A and the other a chip B. The overlapping nozzles N in the joint portion PA on the chip A side are taken to be NA1, NA2 and NA3, and those on the chip B side NB1, NB2 and NB3. As shown at (b), (c), (d) and (e) in FIG. 2, four combinations of nozzles to be used are provided, from which a desired one is chosen, with nozzles to be used set with a print duty of 100% and nozzles not to be used set with a print duty of 0%.

That is, in the case of (b) of FIG. 2, nozzles NA1, NA2, NA3 on the chip A side are set not to be used and nozzles NB1, NB2, NB3 on the chip B side are set to be used. So, the nozzle joint position between the chip A and chip B is at P1. In the case of (c) of FIG. 2, nozzles NA2, NA3 on the chip A side and nozzle NB1 on the chip B side are set not to be used and nozzle NA1 on the chip A side and nozzles NB2, NB3 on the chip B side are set to be used. Thus, the nozzle joint position between the chip A and chip B is at P2. In the case of (d) of FIG. 2, nozzle NA3 on the chip A side and nozzles NB1, NB2 on the chip B side are set not to be used and nozzles NA1, NA2 on the chip A side and nozzle NB3 on the chip B side are set to be used. So, the chip A and chip B have a nozzle joint position at P3. In the case of (e) of FIG. 2, nozzles NB1, NB2, NB3 on the chip B side are set not to be used and nozzles NA1, NA2, NA3 on the chip A side are set to be used. And the chip A and chip B have a nozzle joint position at P4.

As described above, from four combinations of nozzles to be used, shown at (b), (c), (d) and (e) in FIG. 2, a desired in-use nozzle combination is selected so as to remove malfunction nozzles from use. That is, an appropriate nozzle joint position (P1, P2, P3, P4) can be determined so as not to use the malfunction nozzles in the joint portion PA. The degree of freedom of selecting the joint position corresponds to the number of overlapping nozzles in the joint portion PA. So, the degree of freedom of joint position selection can be enhanced by increasing the number of overlapping nozzles.

The malfunction nozzle can be detected from a printed result of test pattern before shipping the printing apparatus or by a user visually checking a printed result of test pattern after the arrival of the printing apparatus. Considering that the malfunction nozzle may change according to the conditions of use of the nozzle after delivery of the printing apparatus, the malfunction nozzle may be determined by a detection unit installed in the printing apparatus.

If such malfunction nozzle exists in the joint portion PA, the joint position is set so as not to use the malfunction nozzle. The joint position may be set, for example, as one of initial settings at time of shipping according to the position of the malfunction nozzle detected before shipping. If the position of the malfunction nozzle is detected by the detection unit in the printing apparatus after the delivery of the apparatus, the joint position can automatically be set according to the result of detection. Further, the user may set the joint position by a printer driver.

Second Embodiment

Figure 3:
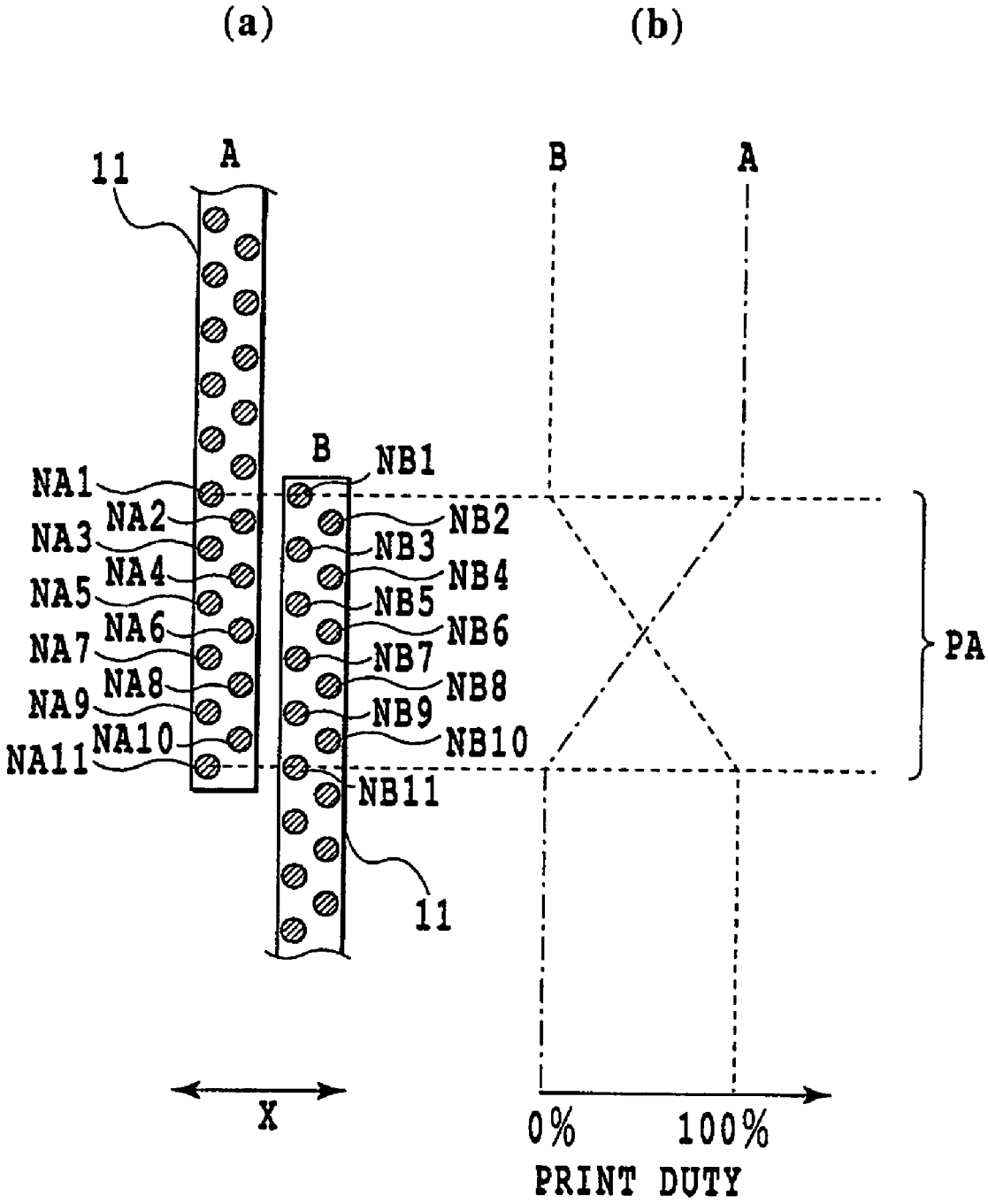
FIG. 3 illustrates an outline configuration of the print heads used in a second embodiment of this invention.

FIG. 3 represents a case where the print duty in the joint portion PA is varied. In this example, as shown at (a) of FIG. 3, there are 11 overlapping nozzles in the joint portion PA, with nozzles NA1-NA11 on the chip A side overlapping nozzles NB1-NB11 on the chip B side. The method of varying the print duty, as disclosed in Japanese Patent Application Laid-open No. 5-057965 (1993), involves changing the print duty (rate of use) of the nozzles according to the positions of the overlapping nozzles on the chip A and chip B. That is, as shown at (b) of FIG. 3, the nozzles NA1-NA11 on the chip A side progressively decrease in dot print density in that order while, to complement the decreasing print density on the chip A side, the nozzles NB1-NB11 on the chip B side progressively increase in dot print density in that order. The print duties of nozzles NA6 and NB6 are 50:50, which means that the two nozzles complement each other at 50% duties in forming an image. As for nozzles NA1-NA5 and nozzles NB1-NB5, the former has higher print duties than the latter. Nozzles NA7-NA11 have lower print duties than nozzles NB7-NBl11.

In the case of FIG. 3, the print duty is varied for all the overlapping nozzles. That is, the number of nozzles whose print duties are changed is the same as the number of overlapping nozzles.

Figure 4:
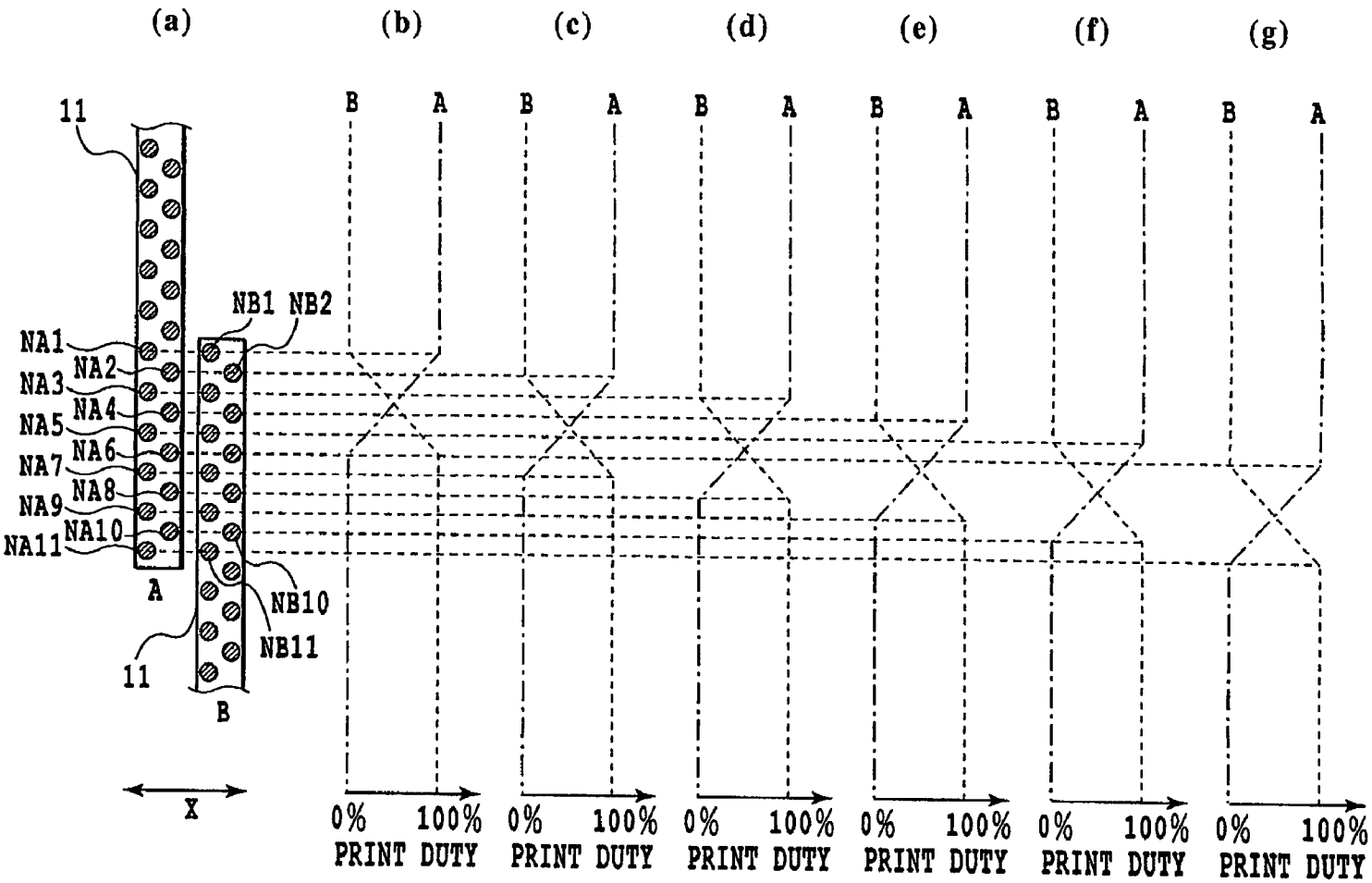
FIG. 4 is an explanatory diagram showing a control mode for the print heads of FIG. 3.

In a second embodiment of this invention shown in FIG. 4, the number of nozzles whose print densities are changed is set smaller than the number of overlapping nozzles. In this example, the number of nozzles whose print duties are changed is set to six on each of the chips A, B, which is smaller than 11 overlapping nozzles on each chip. A nozzle position used to change the print duty, i.e., a joint position between images printed by chip A and chip B can be chosen from among six positions (b) to (g) in FIG. 4. In the case of (b) of FIG. 4, nozzles NA7-NA11 are removed from use; in the case of (c) of FIG. 4, nozzle NB1 and nozzles NA8-NA11 are removed from use; and in the case of (d) of FIG. 4, nozzles NB1, NB2 and nozzles NA9-NA11 are not used. In the case of (e) of FIG. 4, nozzles NB1-NB3 and nozzles NA10, NA11 are not used; in the case of (f) of FIG. 4, nozzles NB1-NB4 and NA11 are not used; and in the case of (g) of FIG. 4, nozzles NB1-NB5 are not used.

By setting the joint position between images printed by chip A and chip B according to the position of malfunction nozzle, it is possible to remove malfunction nozzle from use, i.e., not to use the malfunction nozzle, as in the first embodiment.

In this example, the number of nozzles on the chip A and chip B whose print duties are changed is set to six, smaller than the number of overlapping nozzles on the chips A and B. It is noted, however, that the number of nozzles on each of the chips A, B whose print duties are varied is not limited to six but any desired number may be used. The fewer the number of print duty-changing nozzles, the higher the degree of freedom of removing nozzles from use according to the position of the malfunction nozzle. It is also possible to change, according to the position of malfunction nozzle, the number of nozzles on the chips A, B whose print duties are to be varied. What is required is the ability to select an appropriate print head control mode that controls the print head in a way that does not use malfunction nozzle.

Third Embodiment

Figure 5:
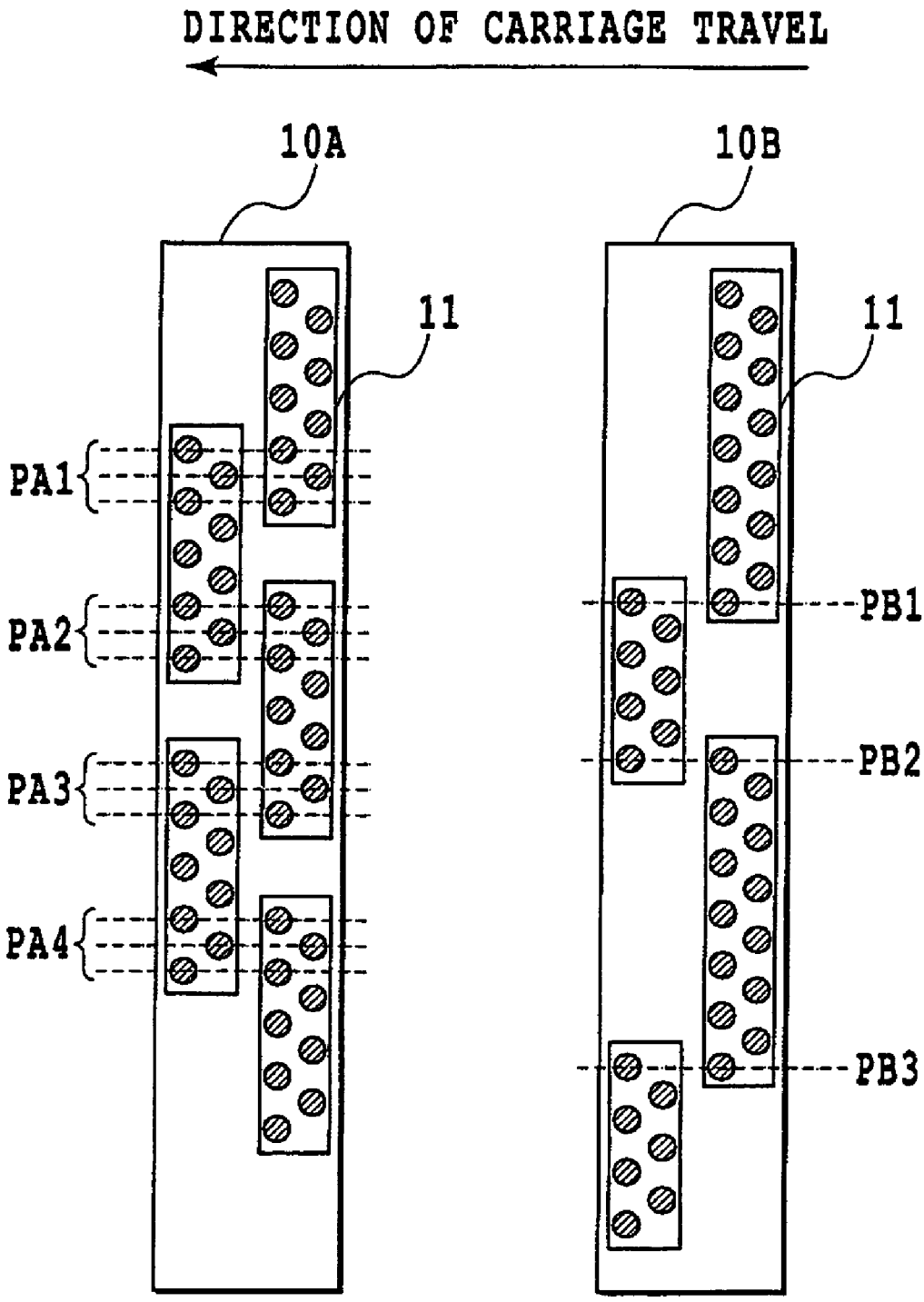
FIG. 5 illustrates an outline configuration of the print heads used in a third embodiment of this invention.

FIG. 5 is an explanatory diagram of a third embodiment of this invention, showing a dual head configuration having two print heads 10A and 10B capable of ejecting the same color ink. In the print head 10A, a plurality of chips 11 overlaps at joint portions PA1-PA4. In the print head 10B, a plurality of chips 11 overlaps at joint portions PB1-PB3.

In the dual head configuration, the print heads 10A and 10B are so arranged that the portions in the print heads that may produce stripe-like image impairments do not overlap each other, making the stripe-like image impairments less noticeable. Portions that may cause stripe-like image impairments may include, for example, joint portions of the chips 11, faulty nozzle, excessive ejection deflection nozzle, and nozzle with extremely small ejection volume. In FIG. 5, the print heads 10A and 10B are set so that the joint portions PA1-PA4 of the chips 11 in the print head 10A do not overlap in position the joint portions PB1-PB3 of the chips 11 in the print head 10B.

In this embodiment, by taking advantage of the degree of freedom of setting the joint position in the first and second embodiment, the joint position is determined so as to avoid the use of malfunction nozzle, such as non-ejecting nozzle and excessive ejection deflection nozzle, that exist in the print heads 10A, 10B. That is, according to the position of malfunction nozzle, an appropriate print head control mode can be set that does not use the malfunction nozzle. It is also possible to set the control modes of the print heads 10A and 10B associatively so that the joint position in the print head 10A does not overlap the joint position in the print head 10B.

As described above, the control modes of the print heads 10A and 10B can be set associatively according to the ink ejection states and ink ejection volumes of those nozzles in the print heads 10A and 10B that are situated on the same raster. That is, if one of the nozzles in the print heads 10A and 10B on the same raster is abnormal, a complementary control is performed to make the other nozzle work in place of the malfunction nozzle.

In the print head 10B of this example, chips 11 of different lengths are arranged in line. In the print head 10B of this construction, if a stripe-like image impairment occurs at a part of the printed image corresponding to the joint portion of the chips 11, the image impairment appear at irregular intervals. This can be expected to make the stripes at the joint portions less distinctive.

Fourth Embodiment

Figure 6:
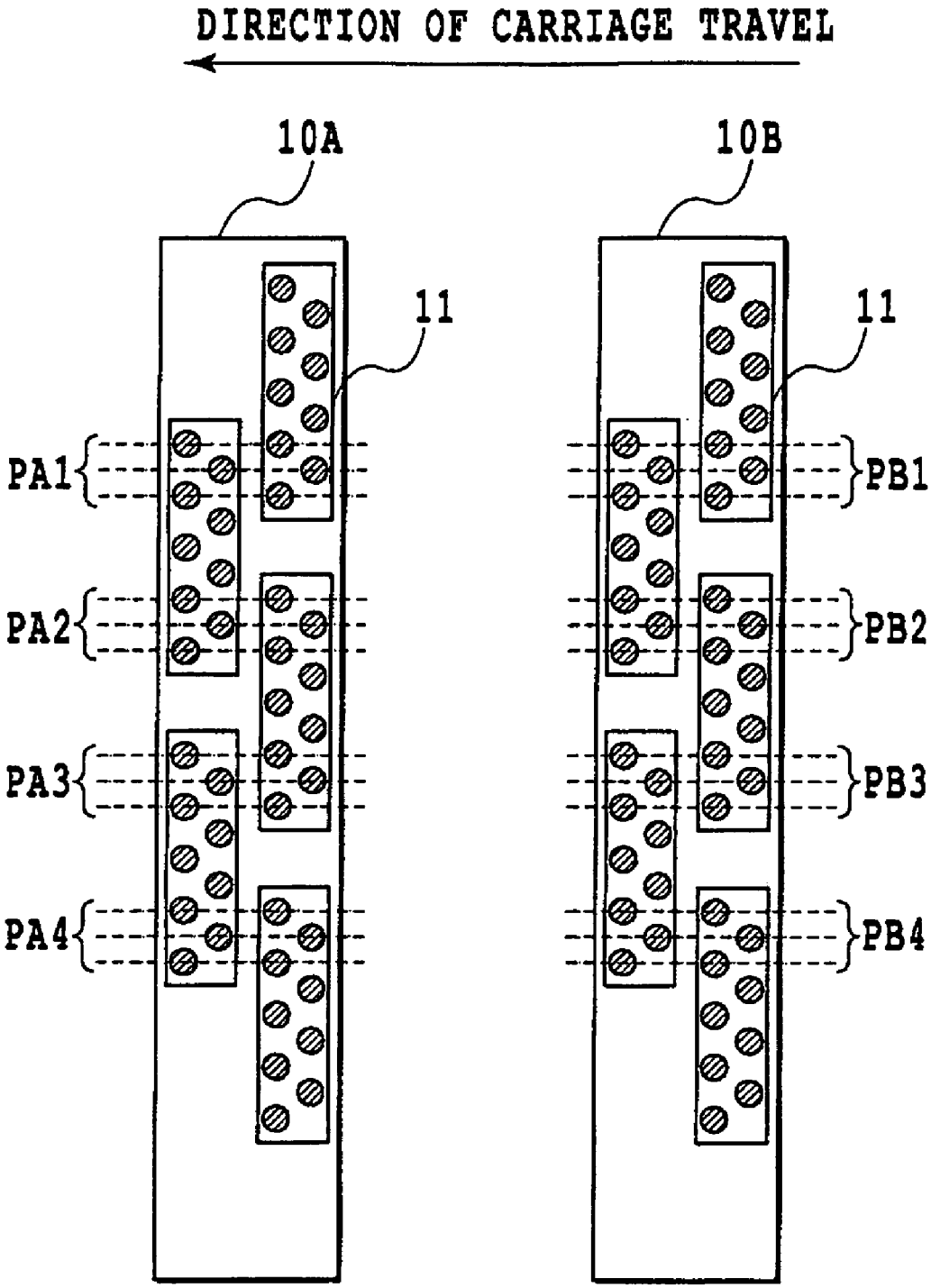
FIG. 6 illustrates an outline configuration of the print heads used in a fourth embodiment of this invention.

FIG. 6 is an explanatory diagram showing a fourth embodiment of this invention. The print head of this example has a dual head configuration comprising two print heads 10A and 10B capable of ejecting the same color ink. In the print head 10A a plurality of chips 11 overlap at joint portions PA1-PA4; and in the print head 10B a plurality of chips 11 overlap at joint portions PB1-PB3.

In this example, stripe-like image impairments produced at the joint portions PA1-PA4 in the print head 10A can be compensated for by the nozzles on the print head 10B side that are situated on the same rasters as the nozzles of the joint portions PA1-PA4. This complementary or corrective printing can be performed by controlling the volume of ink droplet ejected according to the print density and the carriage moving speed. However, if a nozzle situated on the same raster where a stripe-like image impairment is produced and which is adapted to perform a complementary or corrective printing on that raster is faulty, i.e., if the correcting nozzle is a failed nozzle, an excessive deflection nozzle or a nozzle with an extremely small ejection volume, then a desired image correction cannot be realized.

In this embodiment therefore, a joint position is determined that avoids the malfunction nozzle, as in the first and second embodiment. That is, the joint position is determined in a way that prevents a malfunction nozzle from being used as a nozzle that corrects an image flaw formed at the joint portion. By associatively setting the control modes of the print heads 10A and 10B so as to prevent a malfunction nozzle from being used as a nozzle for correcting an image flaw, a desired image correction can be accomplished.

OTHER EMBODIMENTS

This invention can not only be applied to a serial scan type such as shown in FIG. 7, i.e., a printing system that alternates the movement of the print head in the main scan direction and the feeding of a print medium in the subscan direction, but also to a full line type which uses an elongate print head extending over the entire widthwise range of the print medium. In this full line type, the print head and the print medium are moved in one direction relative to each other for continuous printing.

This invention only requires that a desired control mode on the overlapping nozzles be able to be selectively set. In other words, what is required is an ability to remove from use a different nozzle among the overlapping nozzles according to a different control mode.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2005-164452 filed Jun. 3, 2005, which is hereby incorporated by reference herein.

What is claimed is:

1. An ink jet printing apparatus for printing an image on a print medium, comprising:

a print head having a plurality of chips, each of the chips providing a plurality of ink ejection nozzles arrayed in line, printing areas corresponding to a predetermined number of the nozzles in two adjoining chips being overlapped;

a control unit that controls relative movement of the print head and the print medium in a direction crossing a direction in which the nozzles are arrayed, and ejection of ink from the nozzles to print the image;

a detection unit that detects a malfunction nozzle from the plurality of nozzles arrayed in the plurality of chips; and a setting unit that sets whether or not to use each of the predetermined number of nozzles in the two adjoining chips on the basis of the malfunction nozzle detected by the detection unit, wherein the setting unit selectively sets a desired control mode from among a plurality of control modes, the plurality of control modes having different setting numbers of the nozzles which are set as nozzles to be used from each of the predetermined number of nozzles in the two adjoining chips.

2. An ink jet printing apparatus according to claim 1, wherein the plurality of control modes have different boundaries between an image printed by one of the two adjoining chips and an image printed by the other.

3. An ink jet printing apparatus according to claim 2, wherein the plurality of control modes use the predetermined number of nozzles in each of the two adjoining chips so as to decrease a rate of use of the nozzles toward an end of the chip.

4. An ink jet printing apparatus according to claim 1, wherein a plurality of print heads capable of ejecting the same ink are arranged in the direction of the relative movement, and wherein the setting unit associatively sets the control modes for the plurality of the print heads.

5. An ink jet printing apparatus according to claim 4, wherein the control mode for at least one of the print heads is set according to an ink ejection state of those nozzles in at least another print head which are situated on the same rasters as the predetermined number of nozzles in the one print head.

6. An ink jet printing apparatus according to claim 4, further comprising complementary control means which, in the plurality of print heads, associatively controls a plurality of nozzles situated on the same raster to complement at least one nozzle with at least another nozzle.

7. An ink jet printing apparatus according to claim 6, wherein the complementary control means associatively controls the plurality of nozzles situated on the same raster according to ink ejection states of these nozzles.

8. An ink jet printing apparatus according to claim 6, wherein the complementary control means associatively controls the plurality of nozzles situated on the same raster according to ink ejection volumes of these nozzles.

9. An ink jet printing method for printing an image on a print medium, comprising:

a step of providing a print head having a plurality of chips, each of the chips providing a plurality of ink ejection nozzles arrayed in line, printing areas corresponding to a predetermined number of the nozzles in two adjoining chips being overlapped;

a control step that controls relative movement of the print head and the print medium in a direction crossing a direction in which the nozzles are arrayed, and ejection of ink from the nozzles to print the image;

a detection step that detects a malfunction nozzle from the plurality of nozzles arrayed in the plurality of chips; and a setting step that sets whether or not to use each of the predetermined number of nozzles in the two adjoining chips on the basis of the malfunction nozzle detected in the detection step, wherein the setting step selectively sets a desired control mode from among a plurality of control modes, the plurality of control modes having different setting numbers of the nozzles which are set as nozzles to be used from each of the predetermined number of nozzles in the two adjoining chips.

10. A print control mode setting method to set a control mode when printing an image on a print medium, comprising:

a step of providing a print head having a plurality of chips, each of the chips providing a plurality of ink ejection nozzles arrayed in line, printing areas corresponding to a predetermined number of the nozzles in two adjoining chips being overlapped;

a control step that controls relative movement of the print head and the print medium in a direction crossing a direction in which the nozzles are arrayed, and ejection of ink from the nozzles to print the image;

a detection step that detects a malfunction nozzle from the plurality of nozzles arrayed in the plurality of chips; and a setting step that sets whether or not to use each of the predetermined number of nozzles in the two adjoining chips on the basis of the malfunction nozzle detected in the detection step, wherein the setting step selectively sets a desired control mode from among a plurality of control modes, the plurality of control modes having different setting numbers of the nozzles which are set as nozzles to be used from each of the predetermined number of nozzles in the two adjoining chips.

* * * * *

UNITED STATES PATENT AND TRADEMARK OFFICE

CERTIFICATE OF CORRECTION

PATENT NO. : 7,399,049 B2
APPLICATION NO. : 11/443156
DATED : July 15, 2008
INVENTOR(S) : Jahana et al.

It is certified that error appears in the above-identified patent and that said Letters Patent is hereby corrected as shown below:

ON THE COVER PAGE:
At Item (75), Inventors, "Satoshi Wada, Tokyo (JP)" should read --Satoshi Wada, Machida (JP)--.

COLUMN 7:
Line 26, "malfunction" should read --the malfunction--.
Line 27, "malfunction" should read --the malfunction--.
Line 43, "malfunction" should read --the malfunction--.

COLUMN 8:
Line 1, "malfunction" should read --the malfunction--, and "non-ejecting" should read --a non-ejecting--.
Line 2, "excessive" should read --an excessive--.
Line 3, "of mal-" should read --of the mal- --.
Line 21, "appear" should read --appears--.

Signed and Sealed this

Tenth Day of March, 2009

JOHN DOLL
*Acting Director of the United States Patent and Trademark Office*